US006058571A

United States Patent [19]

Patelli et al.

[11] Patent Number: 6,058,571

[45] Date of Patent: May 9, 2000

[54] DEVICE FOR DRAWING A CARDER TEXTILE STRIP

[75] Inventors: Silvano Patelli; Giovanni Battista Pasini, both of Palazzolo Sull'Oglio, Italy

[73] Assignee: Marzoli S.p.A., Palazzolo Sull'Oglio, Italy

[21] Appl. No.: 09/292,847

[22] Filed: Apr. 16, 1999

[30] Foreign Application Priority Data

Apr. 17, 1998 [IT] Italy ..... MI98A0813

[51] Int. Cl.[7] ..... D01H 5/32

[52] U.S. Cl. ..... 19/240; 19/236; 19/239

[58] Field of Search ..... 19/65 A, 98, 99, 19/106 R, 150, 157, 159 R, 236, 239, 240

[56] References Cited

U.S. PATENT DOCUMENTS

| | | | |
|---|---|---|---|
| 3,384,933 | 5/1968 | Yamamoto et al. | 19/65 A |
| 5,621,948 | 4/1997 | Hartung | 19/150 |
| 5,855,043 | 1/1999 | Leifeld | 19/159 R |

*Primary Examiner*—John J. Calvert
*Assistant Examiner*—Gary L. Welch
*Attorney, Agent, or Firm*—Oblon, Spivak, McClelland, Maier & Neustadt, P.C.

[57] ABSTRACT

Device for processing the web of fibers obtained from a carder, by transforming it into a strip, subjecting it to drawing, and collecting it in a container, in which the drawing means consist of a plurality of drawing stations, each of which comprises two or more pairs of rollers, each of which is actuated by its own motor, and is piloted by a control unit which distributes the drawing between the stations.

10 Claims, 2 Drawing Sheets

DEVICE FOR DRAWING A CARDER TEXTILE STRIP

Figure 3:
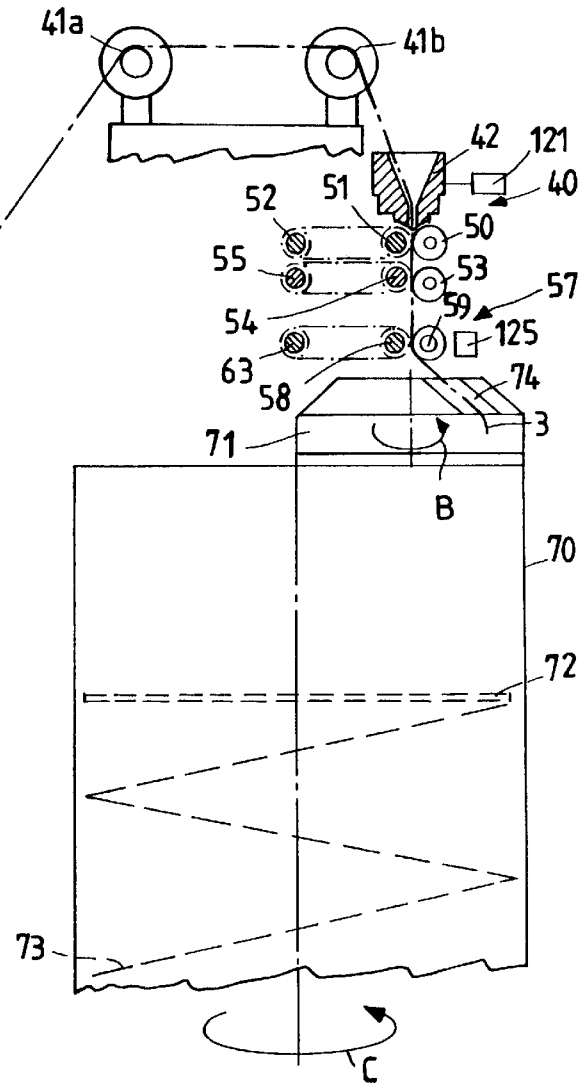
Figure 3:
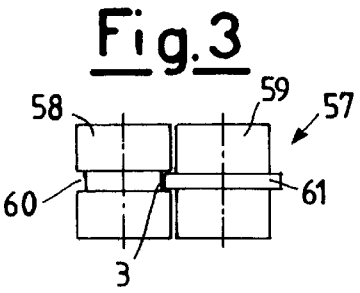

The present invention relates to units for drawing the strip of fibers, which is produced by carding machines, and is designed to be spun, in which the strip is refined and equalised before being collected for transfer to the successive processing steps, in order to be transformed into yarn. More specifically, the present invention relates to a device and a method for drawing by steps, which make it possible to impart to the strip increased drawing and a more regular yarn count. In order to illustrate more clearly the characteristics and advantages of the drawing device and method according to the present invention, they are described hereinafter with reference to the final section of a flat carder, from which, and from the doffing cylinder, or doffer, in particular, there is provided a web of fibres to be condensed into a strip, drawn and gathered, the description being provided purely by way of example, and without any intention of limitation to this type of textile machine, since the invention can advantageously also be applied to fibres in a web or a strip which are produced by other machines for preparation for spinning. According to the known art, this operation is subdivided between two processing units, i.e. a mechanical unit for drawing, and a mechanical unit for collection in a mobile cylindrical receptacle which is currently known as a container. For these units, reference can be made respectively to European patent application EP-A-775.768, and Italian patent 1,276,946 in the name of the same applicant.

In the first unit, drawing is provided by one or more pairs of cylinders or calenders, which are actuated by electric motors with return units, for example with belts, at speeds which are variable moment by moment. Preceding these calenders, on the path of the strip, there is fitted a metal support in the form of a concentrator funnel with a duct, in which the strip itself slides, in which position there is fitted a sensor which is known according to the art, for example which is of the electronic, optical or ultrasound type, in order to measure continuously the diameter, or more specifically, the transverse dimension of the condensed strip, and to determine its yarn count moment by moment, during the transition of the fibres from the condition of a web to the condition of a strip. The sensor for this diameter transmits the instantaneous value measured to a control unit, for example to a processor or computer, which pilots the control of the differential drive which is applied to the pairs of cylinders, such as to modify the drawing, i.e. the elongation induced on the strip, which makes the fibres which constitute the strip run against one another, thus taking the diameter of the strip of fibres to a nominal, pre-set transverse dimension value.

The strip which is released by the drawing unit then reaches the unit for collection and storage in a container, for transport to the successive processing steps in the drawing frames, in order to obtain the roving for the yarn.

In general, the drawing and collection units according to the known art described hitherto have problems of reliability, cost and complexity. The system for automatic regulation of the yarn count, which is constituted by an electronic yarn-count measurer, and by a mechanical unit with a differential speed, which is modulated moment by moment, is complex and costly, because it is necessary to have a high level of sensitivity, and to intervene with accurate modulations in very brief periods of time (automatic regulation within a short or very short period), in order to obtain the same transverse dimension along the entire length of the strip, and to reduce the variations of yarn count of the strip, by means of pairs of cylinders which are increasingly close to one another. In particular, in drawing units which have a single pair of extraction cylinders, it is not possible to correct the variations of the transverse dimension of the strip processed, before the latter is deposited in the container.

The interventions by the drawing unit must take place by means of modulations of an extent which can be substantial, and with high levels of production of strip, in general between 200 and 400 m per minute, and the strip is thus released at a variable linear speed, to which the collection and production unit cannot always respond efficiently.

Figure 1:
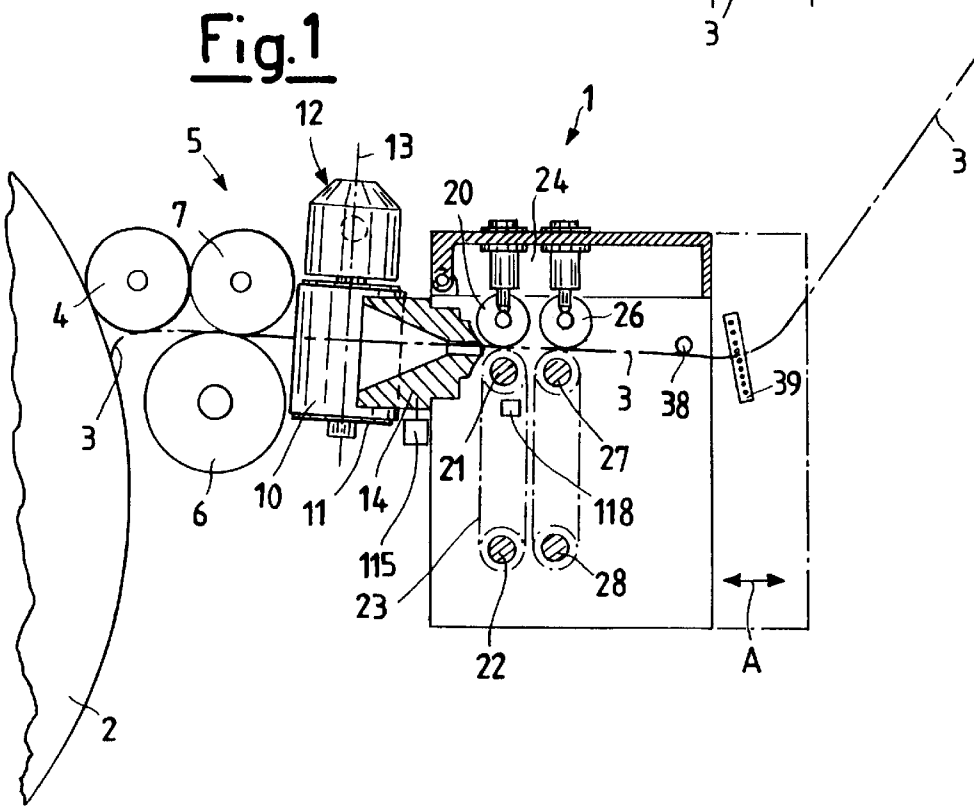
Figure 2:
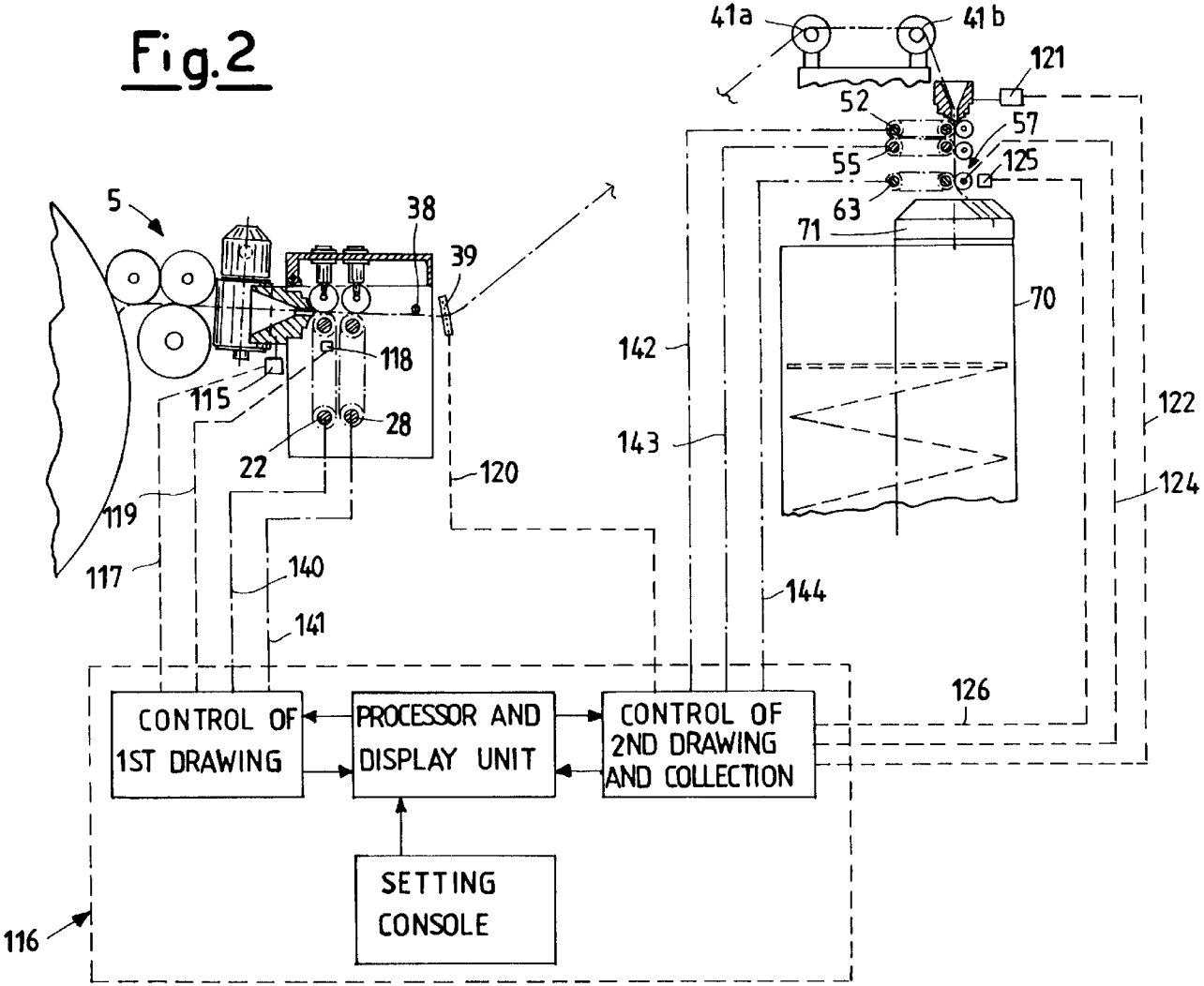

In order to make more apparent the problems involved, and the characteristics of the invention, reference is made by way of example to a typical embodiment of the drawing and collection unit according to the present invention, which is disposed in sequence with a flat carder, illustrated in the drawing in FIG. 1. The drawing in FIG. 2 illustrates the control logic unit for the drawing device in FIG. 1, with use of a computerised unit for processing of data obtained from the control instrumentation, and for control moment by moment of the drawing actuators.

The present invention is defined in the first claim in the broadest meaning of the device, whereas its improved embodiments are defined in the dependent claims. The first drawing unit 1 is supplied, by the discharge cylinder 2 of the carder, which is currently known as the doffer, with the web 3, which is collected by the doffer roller or cylinder 4, and is "accompanied" by a first pair 5 of opposite, compacting collection rollers 6,7. These accompaniment rollers are actuated by a motor, not shown in the figure for the sake of simplicity, at a speed which is compatible with that of collection of the web 3. The structure of the first drawing unit 1 corresponds to that described in application EP-A-775,768 in the name of the same applicant, to which reference can be made for further details. After the initial compacting in the pair 5 of rollers, the web is further compacted by a device with opposite annular belts, which are actuated with compatible motion, which compact the web in the direction at right-angles to that of the compacting in the pair 5, which :s commonly known as the conveyor. In FIG. 1, there can be seen a single one of these opposite belts 10, which is driven around a roller 11 actuated by the motor 12, which rotates around the axis 13, at right-angles to the axes of the rollers 6,7. A similar belt with a similar drive is on the side facing the observer. These belts compact and guide the strip compacted from the web, which initially had a width equivalent to that of the discharge cylinder 2.

The compacted strip 3 continues towards the right, and passes into the funnel collection unit 14, which presents it to the drawing cylinders. In the position of the funnel 14, there is fitted a first sensor 115 for the yarn count of the compacted strip, which, by way of example, is a load cell. This consists of a mobile part, to which there is secured the funnel collection unit 14, which receives the thrust pulses of the web, and also consists of a fixed part, to which there is secured a transducer which co-operates with the mobile part of the sensor, in order to generate an electrical signal, according to the thrust of the latter. The sensor 115 is connected to the control unit 116 with the line 117, in order to transmit to the unit and the line the electrical signal which is generated by the transducer of the sensor, to be processed by the control unit, in order to obtain the yarn count values.

The sensor 115 is connected to the control unit 116 with the line 117, in order to transmit to the unit and the line the yarn count values measured. The unit 116 carries out the processing operations for comparison with the value set, and issues the command for actuation to the motors which drive the drawing cylinders, modifying moment by moment the traction speeds on the strip which is engaged between the opposite cylinders.

These drawing cylinders or rollers consist of two pairs of superimposed rollers with differential drive, in order to impart progressive drawing to the strip which passes between them, towards the right. The first pair of cylinders 20,21 is actuated by the motor 22 with the belt drive 23 on the lower roller 21; the upper roller 20 and lower roller 21 are mounted with their axes parallel to one another, and are thrust resiliently according to their generatrices, by means of a resilient thruster 24. The second pair of cylinders 26,27 is similarly driven by the motor 28, is mounted similarly to the first pair of drawing rollers, and is thrust resiliently according to its generatrices, by means of a resilient thruster, which is similar to the thruster 24. In general, the first pair of drawing rollers 20,21 of the first set is actuated at a linear speed which is the same as, or slightly greater than that of the rollers of the pair 5 of collection rollers, thus maintaining the strip taut, and at the most drawing it slightly. In the embodiment shown in FIG. 1, in the position of the roller 21, there is installed a speed sensor 118, which measures the linear length of strip supplied by the carder to the drawing unit, and this datum is transmitted to the control unit with the line 119. The motor 22 is controlled by the control unit 116 with the line 140, in order to make the motor rotate at a linear speed which is substantially constant, and compatible with that of the pair 5.

Again in general, the true drawing action is carried out by the second pair of rollers 26, 27, which is actuated at a linear speed modulated on the basis of the instantaneous data detected by the sensor 115, relating to the yarn count of the strip which travels along the raiser of the presenter funnel 14, and is controlled by the control unit 116 connected by means of the line 141 to the motor 28. The linear speed differential of the two pairs of cylinders 20,21 and 26,27, thus modulated, makes it possible to induce the drawing, i.e. the elongation of the strip, by making the fibres which constitute the strip run against one another, thus making the diameter of the strip of fibres correspond to the required yarn count. The first actual drawing device, i.e. the presenter 14 and the pair of drawing rollers, is mounted on a mobile frame, which is brought towards and away from the detachment unit positioned upstream, with motion according to the arrow A, between a position of maximum approach, which is indicated by a solid line, and a position of maximum displacement according to the broken line, in a manner which is inversely proportional to the speed of operation of the carder, as already described in the aforementioned application EP-A-775,768. In other words, this mobile frame is provided with means for approach towards, and displacement away from the detachment unit, which is positioned upstream, between a position of maximum approach and a position of maximum displacement, relative to the speed of operation of the carder.

The control unit 116 comprises a unit to control the first drawing, and a unit to control the second drawing and collection of the strip, together with other functions of the machine; it comprises a control console which is provided with a keyboard, by means of which it is possible to enter and amend the control data, such as the yarn count $CV_t$, which is required in the individual cases for both the intermediate part and the end part of the strip, the criteria of distribution for the partial drawings to be imparted by each drawing unit, and the limits of partial and total drawing permitted, and so on. The unit itself is provided with a display unit with a screen, which can record the data detected and controlled for functioning of the machine. The control unit 116 is also provided with a control system, for example with a frequency converter and an actuator, in order to pilot the various motors which are involved in the drawing, at the speed required moment by moment, including the motors of the initial conveying system, such as the pair 5 of rollers, and the annular belt device 10.

According to the present invention, the drawing action is in fact divided up into two or more drawing units 1,40, which are interposed between the carder, which cedes its web, and the container, which collects the latter in the form of a strip. In the embodiment in FIG. 1, the strip 3, which is ceded by the second pair of drawing rollers 26,27, goes from a return element 38, such as that described in Italian patent 1,276,944 in the name of the same applicant, and proceeds towards a second drawing unit 40, which is disposed above the container collection unit. set of guide pulleys 41*a–b* takes the strip 3, which is already partially drawn, to a second drawing unit, which is positioned immediately above the container collection unit, and has a configuration which is similar to the previous unit.

Downstream from the return element 38, there is positioned a sensor 39 to detect the rise in the path of the strip towards the second drawing device 40: this sensor 39 is, for example, of the optical type, with a plurality of aligned emitter and receiver positions, which detect whether the strip 3 which is being processed is passing by a position, and if so, which position. This sensor is connected to the control unit with the line 120. The strip which is obtained from the carding consists of fibres which are virtually parallel, and in general it has limited strength, and therefore there may not be unsupported free sections of it which exceed a certain length.

After the pulleys 41*a–b*, the compacted strip 3 descends towards the collection unit, and goes into a second funnel presenter 42, which presents it to the drawing cylinders. Inside the presenter 42, there is disposed a second sensor 121 for the yarn count of the strip which has been pre-drawn in the first drawing unit, and is similar to the sensor 11. The sensor 121 is also connected to the control unit 116 with the line 122, in order to transmit the yarn count values detected, to the unit and the line. The unit 116 carries out processing operations for comparison with the value set, and also gives the command for actuation to the motors which drive the cylinders of the second device, modifying moment by moment the traction speeds on the strip which is engaged between the opposite cylinders.

These drawing cylinders or rollers consist of two pairs of superimposed rollers, with differential drive in order to impart progressive drawing to the strip which passes between them and downwards. The first pair of cylinders or rollers 50,51 is actuated by the motor 52, similarly to the motors of the first drawing station; the opposite rollers are mounted with their axes parallel to one another, and are thrust resiliently according to their generatrices, with resilient thrust which is similar to that of the first drawing device. The second pair of cylinders or rollers 53,54 is similarly actuated by the motor 55, and is mounted similarly to the first pair of drawing rollers, and is thrust resiliently according to its generatrices, by means of a resilient thruster.

The first pair of drawing rollers 50,51 of the first set is actuated at a linear speed which is the same as, or slightly greater than that of the strip which is output from the first drawing device, and is modulated on the basis of the rising values detected by the sensor 39, thus making is possible to keep the strip taut but not stretched, and allowing it only the drawing caused by its own weight in the free section. The function of the first pair of rollers is thus to retrieve the strip, and present it to the second pair of rollers at controlled speed. The signal which is obtained by the sensor 39 is then also transmitted to the control unit 116, which controls accordingly the motor 52 with the line 142.

The final drawing action before collection is carried out by the second pair of rollers 53,54, which is actuated at a linear speed which is modulated according to the instantaneous data detected by means of the second sensor 121 for the yarn count of the strip, which passes through the presenter 42, with control by the control unit 116, which is connected with the line 143, to the motor 55. The sensor 121 for the yarn count is altogether similar to the sensor 115. The linear speed differential of the two pairs of cylinders 50,51 and 53,54, thus modulated, makes it possible to induce the drawing, i.e. the elongation of the strip, by making the fibres which constitute the strip run against one another, thus making the diameter of the strip of fibres correspond to the yarn count required. The second drawing device, i.e. the presenter 42 and the pairs of drawing rollers, is mounted on a fixed frame above the mobile connection unit, and ends with the final sensor for the yarn count of the strip.

This final sensor 57 for the yarn count of the strip is disposed downstream from the second pair of drawing cylinders 53,54, and comprises a pair of motorised rollers, illustrated in the enlarged detail in FIG. 3. The latter consists of a pair of cylindrical rollers 58,59, which are connected with parallel axes, and are disposed with their generatrices adjacent to one another; the cylindrical surface of one of the rollers is provided with a circular groove 60, and that of the other roller has a projection 61 around the circumference of the cylinder, of a dimension such that the projection penetrates in the groove, so that it fits in the latter, leaving a small gap at the base, i.e. the groove 60 is slightly deeper than the length of the projection 61. The two rollers are thrust against one another by resilient elements, for example by flat springs, which are riot shown in the figure for the sake of simplicity. One of the rollers of the pair 58,59 is driven by a motor 63, and is actuated by the control unit 116 with the line 144, at a speed which is the same as, or slightly greater than that of the second pair 53,54 of drawing cylinders. The pair of rollers 58,59 is supplied with the strip 3 which is output from the final drawing, which passes through the gap between the groove 60 and the projection 61. The volume of the strip 3 which passes through this gap, and more specifically between the base of the groove 60 and the outer surface of the projection 61, exerts a displacement force between the two rollers, and spaces them from one another, according :o the transverse dimension of the strip, i.e. of its yarn count moment by moment. The extent of this force or displacement is thus indicative of the yarn count of the strip. The signal which is supplied by the final sensor 57 is transmitted to the control unit 116 with the line 124, for checking of the yarn count obtained moment by moment, by the second drawing unit 40. The strip then passes to the collection unit.

The collection unit deposits the strip thus obtained in the cylindrical container 70 beneath. The process and functioning of the collection are within the basic scope of the state of the art. The strip has limited traction strength, and is deposited in the container according to superimposed coils, the centres of which are translated according to circles which are coaxial with the distributor plate 71 above. In order to limit the traction forces on the strip, both during the step of depositing and of subsequent extraction, the container 70 is provided with a mobile base 72, which is thrust upwards by a spring 73, which allows the base 72 to descend progressively as the coils are deposited on it, and to rise progressively as the strip is collected, between an initial stop and an end stop. The free section of strip which is suspended is thus limited, even when small quantities of strip are contained in the container. As the strip is deposited in the container, the accumulation increases in thickness but not in level, owing to the shortening of the spring 73, which is gradually compressed by the weight of the deposit above it.

The rotary plate 71 is provided with an eccentric distributor 74, and rotates with motion of revolution around its own axis according to the arrow B, with a speed of approximately hundreds of revolutions per minute. Simultaneously, the container 70 is disposed on a rotary platform, not shown in the figure for the sake of simplicity, which makes the container rotate according to the arrow C, at a speed of rotation of approximately a few revolutions per minute. The strip is thus distributed in coils, the centre of which is translated according to circles which are coaxial with the axis of rotation of the container 70.

The progress of the accumulation of the strip in the container is controlled by means of the so-called footage indicator, by measuring the length of strip which passes through the drawing device. For example, there is fitted to the sensor device 57 for the final yarn count of the strip a totaliser counter 125 for the revolutions of the cylinders 58,59, which is connected to the control unit with the line 126. This counter could also be disposed in the position of one of the pairs of drawing rollers of the machine.

The present invention provides considerable advantages in the method of transformation and drawing of the web of fibres into a strip. In fact, it makes it possible to control and correct, with a high level of productivity of the machine, even minor divergences of the cross-section of the strip, from the pre-set value, by drawing the strip gradually in a plurality of drawing devices or stations in series. Each drawing station functions on the basis of its own field, which is allocated drawing values which are pre-set in the control unit, according to the type and nature of the fibres being processed. Outside these fields, the alarm is activated and the machine stops.

Each drawing station is actuated independently from the others, and is piloted by the control unit, in order to vary its own drawing values within the interval of the field allocated. This unit determines continually the, drawing values to be applied to each station, and allocates them by controlling the motors of the drawing rollers, on the basis of the comparison of the yarn count values upstream and the pre-defined values for the yarn count required. From the measurements obtained from the yarn count sensors downstream from each station, the control unit can also control the drawing value actually obtained, and carry out the corrections necessary.

The control unit 116 functions on the basis of the yarn count values set for the strip being produced, and of the yarn count values measured at the intake and output in the device according to the present invention, and distributes the drawing amongst the plurality of drawing stations 1,40 according to the criteria set, piloting the motors of the device accordingly, and controlling the partial and total result at the output.

The ratio of the drawing values between the first and the subsequent drawing stations can be determined as required. In general, the drawing is distributed harmoniously between the stations, and in general with a ratio between the drawing imparted in the preceding station and that of the following station, which is equivalent, or is less than one. Most of the drawing is preferably carried out in the first station, and the second station is used for refining and equalising of the yarn count.

In all cases, it is necessary to keep carefully under control the rising value of the strip downstream from the first drawing station, by means of the sensor 39. In general, its value is maintained at less than 200 mm, and is preferably between 50 and 150 mm. The roller sensor 57 with conjugated profiles provides the control datum for the final yarn count $CV_t$, in order to check the uniformity of the latter, and its trend in the long term. The footage indicator 125, which is associated with the sensor, provides the control unit 116 with the data relating to near completion of the predetermined footage value for the container. When this value is exceeded, the control unit 116 controls the motor 55 of the last pair of drawing rollers 53, 54 with strong acceleration, thus giving rise to an instantaneous increase in the percentile elongation, and tearing off of the strip.

After the strip has been torn off, the sensor 57 is without strip, and indicates a yarn count of "zero", which gives rise to the procedure for replacement of the container. The container is replaced, and collection in the new container is begun.

The advantages which can be obtained by means of the drawing device and method according to the present invention are multiple, and at least the following of them deserve to be mentioned. The yarn count value of the strip obtained from the carding is quite regular, even when operating at a high level of linear productivity, at speeds of up to 400 m per minute or more. An extensive range of overall drawing values is available for the various strips to be produced in each case. The strips produced require a smaller number of successive passages on the drawing frame before they are spun. The fibres of the strips have sustained a lesser pinching effect, and the subsequent yarn has better values of percentile elongation and strength.

We claim:

1. Device for processing the web of fibers (3) obtained from a carder, by transforming it into a strip and collecting it in a container, comprising means (10) for compacting the web into a strip, and for presentation (14) of the web to the drawing action, drawing means, consisting of opposite rollers which are motorized, and are driven at a differential peripheral speed, and means for collection into a container (70), characterized in that the drawing means consist of at least two drawing stations (1, 40), each of which comprises two or more pairs of rollers (20/21, 26/27, 50/51, 53/54), each of which is actuated by a motor (22, 28, 52, 55), and each of which is preceded by a sensor (115, 121) for the yarn count of the strip, and is followed by a sensor (57) for measuring the final yarn count of the strip, which is output from the last drawing station, before being collected, and in that the said yarn count sensors are connected to a control unit (116) for the device, which unit is provided with means for processing and comparison with a data set of yarn count values, which means, in turn, control the motors (22, 28, 52, 55), and distribute the drawings between the stations (1, 40).

2. Device for processing the web of fibres (3) obtained from a carder, by transforming it into a strip, and collecting it in a container, according to claim 1, characterised in that the last drawing station (40) is disposed immediately above the unit for collection into a container (70).

3. Device for processing the web of fibres (3) obtained from a carder, by transforming it into a strip, and collecting it in a container, according to claim 1, characterised in that the presenter (14) and a pairs of drawing rollers (20/21,26/27) of the first drawing station (1) are mounted on a mobile frame, which is provided with means for approach towards, and displacement away from a detachment unit which is positioned upstream, between a position of maximum approach and a position of maximum displacement, relative to the speed of operation of the carder.

4. Device for processing the web of fibres (3) obtained from a carder, by transforming it into a strip, and collecting it in a container, according to claim 1, characterised in that between the two drawing stations (1,40) there is positioned a sensor (39) for the rise of the path of the strip towards the second drawing station (40), and in that this rise sensor is connected to the control unit (116).

5. Device for processing the web of fibres (3) obtained from a carder, by transforming it into a strip, and collecting it in a container, according to claim 1, characterised in that downstream from the last drawing station (40), there is positioned a sensor (57) for the final yarn count $CV_t$ of the strip, and a footage indicator (125), which measures the footage value of the strip deposited in the collection container (70).

6. Method for processing the web of fibers (3) obtained from a carder, through transformation into a strip, and collection in a container, comprising preparing said strip in a card and drafting combination processing unit wherein control unit (116) processes signals transmitted by sensors (115, 39, 121, 57), determines their values, compares them with a data set, and then controls drafting motors (22, 28, 52, 55), recommencing drawing between the stations (1, 40) in order to produce partial drawing within a pre-allocated field of drawing values for each drawing station, and overall drawing which corresponds to a yarn count value set for the strip produced.

7. Method for processing the web of fibers (3) obtained from a carder, by transforming it into a strip, and collecting it in a container, by means of the device according to claim 6, characterized in that according to a rise value measured by one of the sensors (39) in a path of the strip (3) between one of the drawing stations, the control unit (116) controls retrieval of the strip, by piloting one of the motor (52), which actuates the first pair of rollers (50/51) of another drawing station (40).

8. Method for processing the web of fibers (3) obtained from a carder, by transforming it into a strip, and collecting it in a container, by means of the device according to claim 6, characterized in that a rise value of the strip (3) downstream from one of the drawing stations, measured by the sensor (39), is maintained by the control unit (116), which pilots actuation of at least one of the rollers (50/51), at a value of less than 200 mm.

9. Method for processing the web of fibers (3) obtained from a carder, by transforming it into a strip, and collecting it in a container, by means of the device according to claim 6, characterized in that, in relation to a footage value pre-determined for the collection into a container, and to measurement transmitted by a footage indicator (125), when the footage value is exceeded, the control unit (116) for the device controls a motor (55) of a last pair of drawing rollers (53, 54) with increased acceleration, thus giving rise to an instantaneous increase of percentile elongation, and to breaking or separating of the strip, for replacement of the completed container.

10. Method for processing the web of fibres (3) obtained from a carder, by transforming it into a strip, and collecting it in a container according to claim 6, characterised in that the control unit (116) distributes the drawing with a ratio between the drawing imparted in the preceding station, and that of the following station, which is equal to, or is less than one.

* * * * *